US005238406A

United States Patent [19]

Littell, III

[11] Patent Number: 5,238,406

[45] Date of Patent: Aug. 24, 1993

[54] THERMAL CONTRAST DETAILING FOR INFLATABLE DECOY TARGETS

[76] Inventor: Charles C. Littell, III, 3405 E. 5th St., Dayton, Ohio 45403

[21] Appl. No.: 718,664

[22] Filed: Jun. 21, 1991

[51] Int. Cl.[5] ..... F41G 3/26

[52] U.S. Cl. ..... 434/21; 434/11; 446/220

[58] Field of Search ..... 434/11, 21; 446/220, 446/178; 52/2.17, 2.22, 2.11

[56] References Cited

U.S. PATENT DOCUMENTS

| | | | |
|---|---|---|---|
| H308 | 7/1987 | Tutin et al. . | |
| H694 | 10/1989 | Czajkowski, Jr. . | |
| 2,948,286 | 8/1960 | Turner | 52/2.17 X |
| 3,389,510 | 6/1968 | Stock | 52/2.17 |
| 3,623,727 | 11/1971 | Regelson et al. . | |
| 4,000,749 | 1/1977 | Busco | 52/2.17 X |
| 4,226,292 | 10/1980 | Monte et al. | 434/11 |
| 4,240,212 | 12/1980 | Marshall et al. . | |
| 4,279,599 | 7/1981 | Marshall et al. . | |
| 4,346,901 | 8/1982 | Booth . | |
| 4,428,583 | 1/1984 | Feagle . | |
| 4,526,545 | 7/1985 | Mohon et al. | 434/21 X |
| 4,606,848 | 8/1986 | Bond . | |
| 4,607,849 | 8/1986 | Smith et al. . | |

*Primary Examiner*—Richard J. Apley
*Assistant Examiner*—Karen A. Jalbert
*Attorney, Agent, or Firm*—Fredric L. Sinder; Donald J. Singer

[57] ABSTRACT

Improved thermal contrast detailing for inflatable decoy targets is provided by providing the decoy with gas permeable skin panels for surface areas which would be at a higher temperature relative to other surface areas on the actual target represented by the decoy. Heated, pressurized air is provided to the decoy and escapes through the gas permeable panels making those panels hotter than adjoining gas impermeable panels. The target decoy may also be rigid. Thermal contrast may also be achieved by using chilled, pressurized air. The invention may also be used for providing any thermal radiance area-source.

14 Claims, 1 Drawing Sheet

THERMAL CONTRAST DETAILING FOR INFLATABLE DECOY TARGETS

RIGHTS OF THE GOVERNMENT

The invention described herein may be manufactured and used by or for the Government of the United States for all governmental purposes without the payment of any royalty.

BACKGROUND OF THE INVENTION

The present invention relates generally to military decoys, and more particularly to an inexpensive inflatable thermal target decoy.

Military decoys are primarily used for either of two purposes. One is simulating full size military targets to mislead an enemy. The other, and more common, purpose is to simulate military targets for target practice.

Target decoys should be inexpensive, convenient and realistic. A presently popular construction method for making target decoys that simulate a complex target in three dimensions, and which can be quickly deployed from a compact package and later quickly dismantled, is to use balloon-like inflatable membranes. An important requirement for such decoys is that they present a realistic thermal image to thermal imaging surveillance. To provide thermal contrast detailing, and thus make a deceptively realistic thermal signature for the inflatable decoy targets, the prior art has generally placed electric resistance heater panels on the decoys to simulate engine covers or other outside surface components that normally would be proportionally warmer than the rest of the decoy surface. These thermal panels generally double the cost of the inflatable decoy. Passive solar heating has also been used for daytime applications.

The prior art includes a variety of other methods for simulating thermal signatures on a decoy. While these other methods apparently have not been used in combination with an inflatable decoy, their teachings could be applied to inflatable target decoys. For example, U.S. Pat. No. 4,279,599 to Marshall et al teaches the use of an etched flat metal plate where the etched surface is more emissive than its surrounding unetched area and, from solar heating of the plate, presents a deceptively warmer surface area. Where sufficient sunlight is not available to heat the plate, Marshall et al teaches attaching an electric contact heater to the back of the plate.

Another example of a prior art teaching that could be adapted to produce deceptive thermal signatures on an inflatable decoy is U.S. Statutory Invention Registration (SIR) H308 to Tutin et al. The Tutin et al SIR teaches, as part of the use of a fabric-covered frame aircraft decoy, mixing metal particles with the fabric paint to increase the infrared and radar signatures of the decoy over its entire surface.

The prior art also includes using pyrotechnics to produce a deceptive thermal signature.

Unfortunately, all of the prior art, both that now used and that which may be adapted in the future, are add-on solutions, increasing complexity and cost. None of the prior art teachings take advantage of some inherent feature of inflatable decoys to provide deceptive thermal signatures. Such a solution would be simpler, more convenient and less expensive.

Thus it is seen that there is a need for an inflatable decoy that provides a deceptive thermal signature without the need for expensive and complicated add-on apparatus.

It is, therefore, a principal object of the present invention to provide an inflatable decoy target that utilizes its inherent supply of pressurized air to help produce thermal contrast detailing over the surface of the decoy.

It is another object of the present invention to provide different methods for heating the pressurized air used to enhance the thermal contrast.

It is a further object of the present invention to provide a general method for making thermal radiance area sources and patterns.

It is a feature of the present invention that only a single heat source, or heater, is needed for each decoy.

It is a further feature of the present invention that the heater is separate from the decoy and can thus provide heat to more than one decoy at the same time.

It is an advantage of the present invention that the separate heater is not destroyed with the decoy.

It is a further advantage of the present invention that the heater can be integrated with the inflation blower, and the same inflation blower can be used with both heated and nonheated inflatable decoys.

It is another advantage of the present invention that its fabrication will be a straightforward and inexpensive modification to already existing inflatable decoy construction methods.

These and other objects, features and advantages of the Present invention will become apparent as the description of certain representative embodiments proceeds.

SUMMARY OF THE INVENTION

The present invention provides a target decoy which includes an integral method for providing thermal contrast detailing. The unique discovery of the present invention is that thermal contrast detailing can be provided simply by making part of the fabric forming an inflatable decoy out of gas permeable fabric and inflating the decoy with heated air, so that the heated air escapes through the gas permeable fabric, thus transferring thermal energy, or heat, to the fabric, and making the gas permeable fabric surface area warmer than that of the gas impermeable parts of the decoy.

Accordingly, the present invention is directed to an inflatable decoy comprising sheet material forming a bladder that, when filled with a gas, will inflate into a preselected shape, wherein at least one preselected part section of the sheet material is made of gas permeable material. The inflatable decoy may include means for supplying to the bladder heated, pressurized gas, whereby the heated gas escapes through the gas permeable material so that the surface area of the gas permeable material becomes warmer than the rest of the surface area of the decoy. The means for supplying heated, pressurized gas may be the exhaust of an internal combustion engine. The inflatable decoy may alternately include means for supplying to the bladder chilled, pressurized gas, whereby the chilled gas escapes through the gas permeable material so that the surface area of the gas permeable material becomes cooler than the rest of the surface area of the decoy.

The invention is also directed to a rigid decoy comprising an outer surface having a preselected three-dimensional shape, wherein at least one preselected part section of the outer surface is gas permeable. The rigid decoy may include means for supplying to the inside of the decoy heated, pressurized gas, whereby the heated gas escapes through the gas permeable material so that the surface area of the gas permeable material becomes warmer than the rest of the surface area of the decoy. The rigid decoy may also include means for supplying to the inside of the decoy chilled, pressurized gas, whereby the chilled gas escapes through the gas permeable material so that the surface area of the gas permeable material becomes cooler than the rest of the surface area of the decoy.

The invention is further directed to a method for providing thermal radiance area-sources, and thermal contrast detailing over a surface area, comprising the steps of providing a material having a back and a front, wherein the material comprises gas permeable and gas impermeable regions between corresponding front part surface areas and back part surface areas, and supplying heated, pressurized gas to the back part surface areas of gas permeable regions, whereby the heated gas passes through the gas permeable regions and corresponding front part surface areas, so that those front part surface areas of the material become warmer than the front part surface areas of the gas impermeable regions of the material. The material may be sheet material. The material may also be fabric. The method may alternately include supplying chilled, pressurized gas to the back part surface areas of gas permeable regions so that the corresponding front part surface areas become cooler than the front part surface areas of the gas impermeable regions of the material.

DESCRIPTION OF THE DRAWING

The present invention will be more clearly understood from a reading of the following detailed description in conjunction with the accompanying drawing wherein.

DETAILED DESCRIPTION

Figure 1:
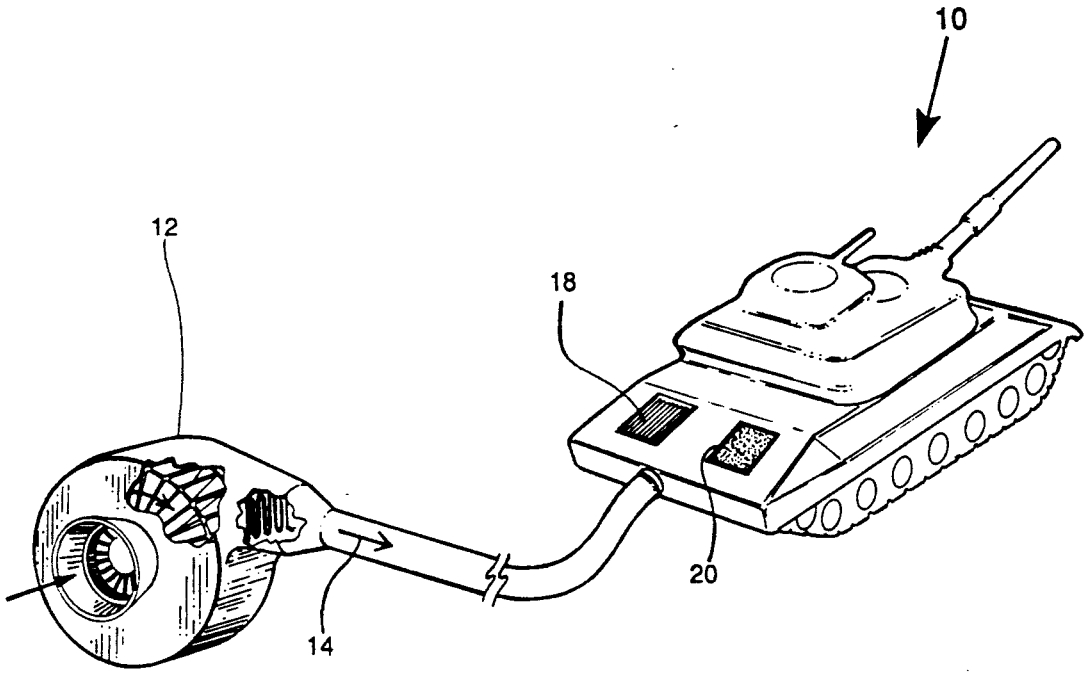
FIG. 1 is a perspective view of an inflatable decoy and a schematic source of heated, or cooled, pressurized air according to the teachings of the present invention.

Referring now to the FIG. 1 drawing, there is shown a perspective view of an inflatable decoy 10 and a schematic source 12 of heated, pressurized air 14. Inflatable decoy 10 may, of course, have the shape of any desired target, but in this example has roughly the three-dimensional shape of a tank. Tank decoy 10 may be made by gluing together, or otherwise attaching, skin panels of different shapes to form a bag or bladder having a preselected shape, in this example that of a tank. Most of the skin panels forming tank decoy 10 are made of a gas impermeable fabric so that, in the case of a conventional inflatable decoy, after initial inflation only a small volume of air needs to be continuously supplied to maintain internal air pressure, and the desired shape of decoy 10. Because most gas impermeable fabrics, and their accompanying seams, leak, even only slightly, a pressurized air source is generally left connected to the decoy to maintain its pressurization and shape. Skin panels 18 and 20, however, are made of gas permeable fabric. Skin panel 18 is made of a lightweight woven fabric that has not been conventionally sealed with a plastic sealant backing. Skin panel 20 is made with conventional gas impermeable fabric that has been fabricated with many small holes as an example alternate means for making a gas permeable skin panel.

The operation of decoy 10 is simple. Heated, pressurized air source 12 supplies heated air 14, or any suitable heated gas, to decoy 10 at a rate sufficient to replace, in addition to normal leakage, the air, or gas, lost through gas permeable panels 18 and 20.

Heated air 14 escaping through skin panels 18 and 20 transfers part of its thermal energy, or heat, to the skin panels so that those surface areas of the decoy become warmer than the rest of the decoy. In this particular example embodiment, the skin panels will appear to be typical engine covers to thermal imaging surveillance or targeting apparatus.

It should be noted that the escaping hot or warm air has a relatively low emissivity, and that it is the heated or warmed skin panels which emit significant thermal radiation.

It should also be noted that it is generally unnecessary that the heated skin panels reach the same temperature that a real, for example, engine cover, only that there be a sufficient contrast between the thermal emissivity from the gas permeable surface areas and the gas impermeable surface areas.

In one test, a bag shaped test target was constructed of fiber-reinforced plastic drop-cloth material and included a six by six inch hole covered by a patch of lightweight woven synthetic fabric. The test target was first pressurized with ambient temperature air, and then with heated air. Thermal radiation measurements, in degrees C. (8–12 microns, emissivity=1), yielded readings of, with ambient pressurized air, bag=18.4 and patch=19.7; and, with heated pressurized air, bag=19.1 and patch=36.1.

Heated, pressurized air may, of course, be supplied from a variety of sources. A particularly good source would be the exhaust from a small internal combustion engine. The heater and blower may be integrated, or a separate heater may supply heated air to a blower.

A variety of useful enhancements and variations of the disclosed invention will readily appear to those with skill in the art of the invention. For example, reflective paint can be applied to the backs of the gas impermeable skin panels to enhance the thermal contrast by further limiting the amount of heat transferred to the gas impermeable panels. Also, more elaborate openings may be utilized that can be variably opened and closed so that a thermostatic control may be utilized to create preselected thermal signatures.

Another variation of the described invention is to use chilled air instead of heated air, so that the gas permeable areas will become cooler, and thus present a cooler thermal image to thermal imaging surveillance. Air source 12 may be viewed as a source of chilled, pressurized air for this embodiment.

Those with skill in the art of the invention will also see that the listed advantages of using a separate pressurized air source as the source of heat will also work for rigid decoys. Most rigid decoys are also hollow and need only have added skin panels of gas permeable material to achieve the same useful results. The heated air may be delivered by either supplying to the inside of the entire decoy, or be ducted to the specific locations. Decoy 10 may be viewed as having a rigid structure for this embodiment.

Those with skill in the art of the invention will further see that its teachings are ideally suited to fabricate very large scale, or architectural, decoys.

Those with skill in the art of the invention will also see that its teachings extend to a general method for providing thermal radiance area-sources and thermal contrast detailing over a surface area. The general method can be used to provide thermal optical definition patterns, greybody and blackbody thermal optical calibration sources, and the like.

The disclosed thermal target decoy successfully demonstrates the use of an adaptation of an inherent feature of Prior art apparatus to provide features that previously required more complex additional components. Although the disclosed apparatus is specialized, its teachings will find application in other areas where apparatus will benefit from reduction of parts and simplification.

It is understood that various modifications to the invention as described may be made, as might occur to one with skill in the field of the invention, within the scope of the claims. For example, the claimed bladder may comprise either a plurality of individual bladders, or a single large manifold. Therefore, all embodiments contemplated have not been shown in complete detail. Other embodiments may be developed without departing from the spirit of the invention or from the scope of the claims.

I claim:

1. An inflatable decoy for simulating the particular thermal signature of a preselected military target, comprising:

(a) sheet material forming a bladder that, when filled with a gas, will inflate into the shape of the military target; and, (b) one or more preselected part sections of the sheet material made of gas permeable material in the outline shape of corresponding surface areas of the military target under which one or more corresponding surface areas of the actual military target would be positioned an engine or refrigerator and for which one or more preselected part sections a thermal radiance different from that of the rest of the decoy is desired.

2. The inflatable decoy according to claim 1, further comprising means for supplying to the bladder heated, pressurized gas, whereby the heated gas escapes through the gas permeable material so that the surface area of the gas permeable material becomes warmer than the rest of the surface area of the decoy.

3. The inflatable decoy according to claim 2, wherein the means for supplying heated, pressurized gas comprises the exhaust of an internal combustion engine.

4. The inflatable decoy according to claim 1, further comprising means for supplying to the bladder chilled, pressurized gas, whereby the chilled gas escapes through the gas permeable material so that the surface area of the gas permeable material becomes cooler than the rest of the surface area of the decoy.

5. An inflatable decoy for simulating the particular thermal signature of a preselected military target, comprising:

(a) sheet material forming a bladder that, when filled with a gas, will inflate into the shape of the military target;

(b) one or more preselected part sections of the sheet material made of gas permeable material in the outline shape of corresponding surface areas of the military target under which one or more corresponding surface areas of the actual military target would be positioned an engine or refrigerator and for which one or more preselected part sections a thermal radiance different from that of the rest of the decoy is desired; and (c) means for supplying to the bladder heated, pressurized gas, whereby the heated gas escapes through the gas permeable material so that the surface area of the gas permeable material becomes warmer than the rest of the surface area of the decoy.

6. A rigid decoy for simulating the particular thermal signature of a preselected military target, comprising:

(a) a rigid outer surface having the shape of the military target; and (b) one or more preselected gas permeable part sections of the rigid outer surface in the outline shape of corresponding surface areas of the military target under which one or more corresponding surface areas of the actual military target would be positioned an engine or refrigerator and for which one or more preselected gas permeable part sections a thermal radiance different from that of the rest of the decoy is desired.

7. The rigid decoy according to claim 6, further comprising means for supplying to the inside of the decoy heated, pressurized gas, whereby the heated gas escapes through the gas permeable material so that the surface area of the gas permeable material becomes warmer than the rest of the surface area of the decoy.

8. The rigid decoy according to claim 6, further comprising means for supplying to the inside of the decoy chilled, pressurized gas, whereby the chilled gas escapes through the gas permeable material so that the surface area of the gas permeable material becomes cooler than the rest of the surface area of the decoy.

9. A method for providing thermal radiance area-sources, and thermal contrast detailing, over a surface area of a decoy simulating a preselected military target, comprising the steps of:

(a) providing a material having a back and a front, wherein the material comprises gas permeable and gas impermeable regions between corresponding front part surface areas and back part surface areas, and wherein the corresponding front part and back part surface areas covering gas permeable regions have the outline shape of counterpart surface areas of the military target under which one or more counterpart surface areas of the actual military target would be positioned an engine and for which corresponding front and back part surface areas covering gas permeable regions a thermal radiance different from that of the rest of the decoy is desired; and, (b) supplying heated, pressurized gas to the back part surface areas of gas permeable regions, whereby the heated gas passes through the gas permeable regions and corresponding front part surface areas, so that those front part surface areas of the material become warmer than the front part surface areas of the gas impermeable regions of the material.

10. The method of providing thermal radiance area-sources according to claim 9, wherein the material is sheet material.

11. The method of providing thermal radiance area-sources according to claim 9, wherein the material is fabric.

12. A method for providing thermal radiance area-sources, and thermal contrast detailing, over a surface area of a decoy simulating a preselected military target, comprising the steps of:

(a) providing a material having a back and a front, wherein the material comprises gas permeable and gas impermeable regions between corresponding front part surface areas and back part surface areas, and wherein the corresponding front part and back part surface areas covering gas permeable regions have the outline shape of counterpart surface areas of the military target under which one or more counterpart surface areas of the actual military target would be positioned a refrigerator and for which corresponding front and back part surface areas covering gas permeable regions a thermal radiance different from that of the rest of the decoy is desired; and, (b) supplying chilled, pressurized gas to the back part surface areas of gas permeable regions, whereby the chilled gas passes through the gas permeable regions and corresponding front part surface areas, so that those front part surface areas of the material become cooler than the front part surface areas of the gas impermeable regions of the material.

13. The method for providing thermal radiance area-sources according to claim 12, wherein the material is sheet material.

14. The method for providing thermal radiance area-sources according to claim 12, wherein the material is fabric.

* * * * *